US005182886A

United States Patent [19]

Bateman et al.

[11] Patent Number: 5,182,886

[45] Date of Patent: Feb. 2, 1993

[54] BUILDING ELEMENTS AND JOINTS THEREFOR

[75] Inventors: Colin N. Bateman, Stamford; Peter L. Clark; William G. Carter, both of Nottingham, all of Great Britain

[73] Assignee: National Research Development Corporation, London, United Kingdom

[21] Appl. No.: 635,601

[22] PCT Filed: Jul. 27, 1989

[86] PCT No.: PCT/GB89/00851

§ 371 Date: Jan. 22, 1991

§ 102(e) Date: Jan. 22, 1991

[87] PCT Pub. No.: WO90/01591

PCT Pub. Date: Feb. 22, 1990

[30] Foreign Application Priority Data

Aug. 2, 1988 [GB] United Kingdom ..... 8818307
Aug. 2, 1988 [GB] United Kingdom ..... 8818308

[51] Int. Cl.[5] ..... E04B 9/10

[52] U.S. Cl. ..... 52/125.6; 52/79.2; 52/79.13; 52/396; 52/461; 52/747

[58] Field of Search ..... 52/125.6, 79.1, 79.2, 52/79.13, 745, 79.9, 235, 396, 403, 401, 461, 582, 583, 584, 747, 741, 743; 403/288

[56] References Cited

U.S. PATENT DOCUMENTS

| | | | |
|---|---|---|---|
| 2,122,696 | 7/1938 | Poston | 52/389 |
| 3,165,987 | 1/1965 | Hirst et al. | 52/396 X |
| 3,921,362 | 11/1975 | Cortina | 52/125.6 X |
| 4,128,983 | 12/1978 | Matsubara | 52/403 X |
| 4,435,939 | 3/1984 | Hird | 52/582 |
| 4,589,242 | 5/1986 | Mouliniéet al. | 52/396 |
| 4,649,682 | 3/1987 | Barret, Jr. | 52/612 X |

FOREIGN PATENT DOCUMENTS

| | | | |
|---|---|---|---|
| 2034066 | 1/1972 | Fed. Rep. of Germany | 52/125 |
| 1356987 | 6/1974 | United Kingdom . | |

*Primary Examiner*—David A. Scherbel
*Assistant Examiner*—Kien Nguyen

[57] ABSTRACT

A method of building a free standing or building wall using prefabricated wall panels (10, 12, 14) wherein the assembly is accomplished at a factory from traditional or conventional building bricks or blocks. Each panel has an integral support means (26) to resist separation of the bricks or blocks when lifted for transport. A joint element (118) is provided between adjacent edges of adjacent panels and serves a labyrinth seal (102) with interleaved seal elements extending lengthwise of the joint. Springs (124) act between opposite sides (120, 122) of the joint so that it is resiliently compressed to accommodate differing spacings between the panels. A thermal insulation compartment (126, 128) is provided between the joint elements.

7 Claims, 5 Drawing Sheets

BUILDING ELEMENTS AND JOINTS THEREFOR

This invention relates to building elements or panels, methods of building a wall or like structure therefrom, and to joint elements for placement between building or wall elements or panels to provide a seal therebetween. An example of the application of the invention is to prefabricated wall panels and methods of constructing and assembling same with joint means between them. The invention is applicable to industrial and commercial and residential buildings, free-standing walls such as garden walls, boundary walls, barrier walls or any other kind of wall whether for residential industrial or commercial purposes, and to other structures.

The construction of buildings using sectional or prefabricated components has been undertaken for many years throughout the world. In the United Kingdom, buildings employing prefabricated panels and structures have consistently failed, for various reasons, to meet the requirements made of them. As a result, there is now considerable resistance to their continued use. The reasons for these problems include ineffective sealing between adjacent edges of the panel, poor thermal insulation provided by the panel and a lack of choice of decorative finishes for the panel and an inability to match traditional materials such as brick, stone and timber in this regard.

The conventional way of constructing prefabricated building panels involves the use of reinforced concrete which is cast in moulds.

There is disclosed in GB 1169022 (Coal Industry) a method of building a wall or like structure, as defined in the pre-characterising portion of claim 1 hereof, together with a disclosure of a wall panel or element as defined in the pre-characterising portion of claim 9 hereof. The method and panel or element disclosed in this prior specification involves the use of an external jig in which building bricks are built up around a wire mesh having vertical and horizontal wires, the horizontal wires of the mesh passing between horizontal courses of the bricks, and the vertical wires passing vertically through the bricks, at least some of the bricks being slotted to receive the vertical wires. The assembled wall panel or element can then be lifted by means of a support tube extending through loops formed at the upper ends of the wires. The external jig is used for transport purposes, but is then detached when the wall panel or element is to be assembled with others, on site.

This prior proposal has certain useful features, but suffers from the disadvantage that the method of construction involving the embedding of wire mesh within the brick work, leads to undue complication and expense.

There is disclosed in WO 88/03204 (Loper) a prefabricated panel for building wall construction, in which a rigid supporting frame is covered on one face by masonry or ceramic cladding. The cladding is held to the supporting frame by a composite fastener system comprising individual supports extending outwardly from the frame so as to underlie the cladding to carry the dead weight thereof.

Resilient means adhesively secures the cladding to the support frame to resist live loading thereof, such as arises from the influence of wind around buildings. This prior proposal may well be suitable for mounting and supporting relatively lightweight and high area and high cost ceramic cladding, but provides little assistance with regard to the prefabrication of walls in which building elements such as bricks and the like need to be used and supported in a simple direct way applicable to factory construction using relatively unskilled labour.

There is disclosed in FIG. 10 of FRl, 310, 670 a joint assembly as defined in the pre-characterising portion of claim 13 hereof. In the joint assembly of this French patent there is provided a joint element at each side of the gap between the edges of the building elements. However, the only structure bridging across the gap between theses adjacent edges is the cap structure which is external to the building elements and is merely physically located by engagement of tooth elements with those of the joint elements. As a result, the joint assembly provides very limited closure and sealing of the gap between the building elements, simply by means of the single laminar structure of the cap itself, and thus improvements in this and related respects remain to be made.

An object of the present invention is to provide a method and apparatus offering improvements in relation to one or more of the matters discussed above, or generally.

According to the invention there is provided a method and apparatus as defined in the accompanying claims.

In a preferred embodiment, faced building blocks or bricks are bonded in vertically stacked relationship, in a factory, using a suitable mortar, to produce a prefabricated panel. Each panel consists of two leaves of masonry with a cavity space between them. A precast concrete beam or a beam of any other suitable material such as stone (whether natural or artifical), ferrous or non-ferrous metal or a combination of all these, is provided both at the top and the bottom of the panel. The lower beam has two threaded sockets cast or otherwise provided in its upper surface. The upper beam has two slot holes positioned to align with the threaded sockets in the lower beam. Two vertical threaded tie bolts or tie-wires or the like are passed through the upper beam, through the cavity and are screwed into the threaded sockets in the lower beam. Tension is applied to the bolts to produce corresponding compression in the panel, by means, for example, of tensioning nuts screw-threadedly engaging the upper ends of the bolts or ties. The result is a composite cohesive cavity walling panel.

The panels can be lifted mechanically for storage and placement. On assembly, successive panels are secured to each other by straps. The bolts or ties may be slackened after assembly, and removed if desired, or left fully tensioned.

Sealing between successive panels is provided by means of a joint element. The joint element comprises a metal or plastic based material and provides for a gap of from 25 to 100 millimetres, and preferably 40 to 80 millimetres gap between the panels to be sealed. The joint element resists water penetration across the joint and provides a high insulation portion minimising heat losses through the joint. A capping on the internal and external surfaces of the joint element provides a decorative finish and prevents the entry of dust and vermin. Once fitted, the joint element does not require adjustment or maintenance. It may constitute a structural element of the assembled wall for example it may be fixed to the Panel beams to provide support, particularly in free-standing walls.

The joint element comprises four parts. Two side units are located between adjacent panel edges and positioned by means of lugs which fit into the exposed cavity at the end of each panel. An internal capping piece incorporating insulation is press fitted and clipped between the shoulders of the side units of the joint element. The external capping is screwed to the projecting portion of the nearest projecting fin of the joint element. A water tray is incorporated at the base of the wall to collect and shed any water which has penetrated.

The joint element may be constructed of masonry, ferrous or non-ferrous metals, plastics (synthetic polymers) or other suitable materials and can be produced using traditional fabrication techniques or by an extrusion process.

The embodiments of the invention described below provide significant advantages including, effectively, the transfer of the traditional masonry crafts into a factory controlled environment. This leads to the opportunity for greater quality assurance to be achieved, than is normally attainable on building sites. Also, a reduction in the high percentage of materials and labour wastage normally associated with building site activities is achieved, and an increase in the speed at which walls can be built. There is also the distinct possibility that, after training, semi-skilled labour could be used to produce panels. This will enable the creation of numerous employment opportunities nationally. Also, the external facing material may be selected from a wide range of colours and textures to satisfy local authority planners, architects and clients. A range of different panel sizes can be produced to satisfy the type of building proposed, and the thermal transmittance value of a wall may be adjusted to suit individual and/or statutory requirements.

Embodiments of the invention will now be described by way of example with reference to the accompanying drawings in which:

FIGS. 1 A, 1B, and 1C show a wall panel with three variations;

FIGS. 2A, 2B, and 2C show a wall panel having the same variations as in FIGS. 1A-1C with a larger width;

FIGS. 3A, 3B, and 3C show a wall panel having the same variation as in FIGS. 1A-1C with a larger width than FIGS. 2A-2C;

FIGS. 4, 5, and 6 show front elevation views of buildings incorporating the panels of the preceding FIGURES;

Figure 1C:
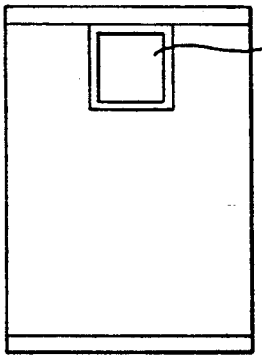
Figure 2C:
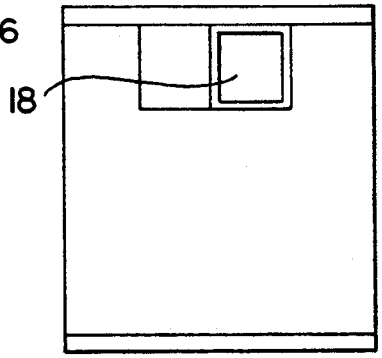
Figure 3C:
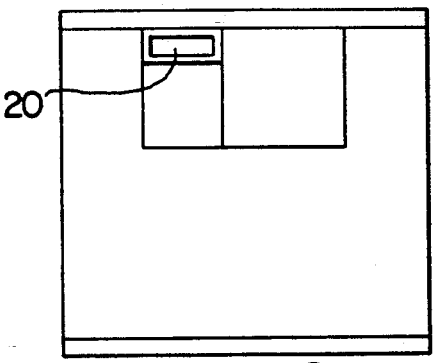
Figure 1B:
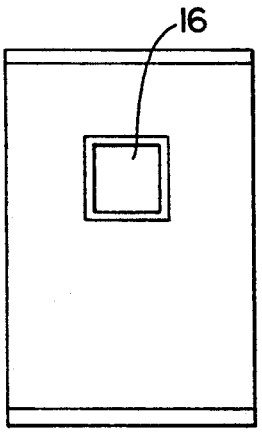
Figure 2B:
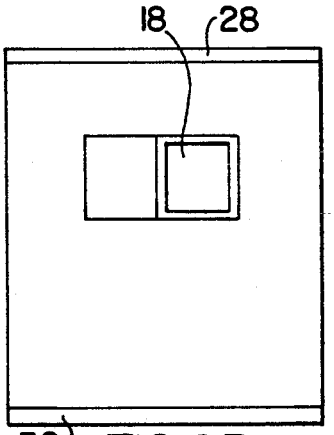
Figure 3B:
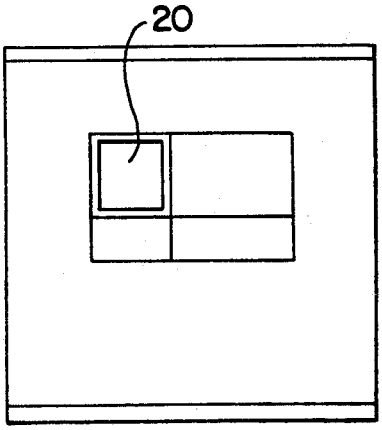
Figure 1A:
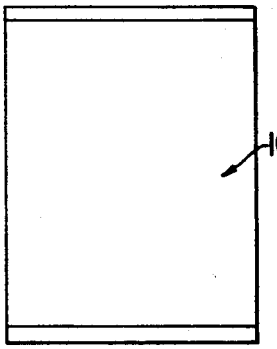
Figure 2A:
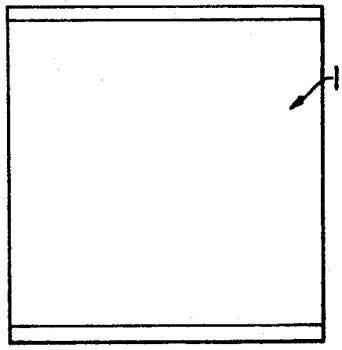
Figure 3A:
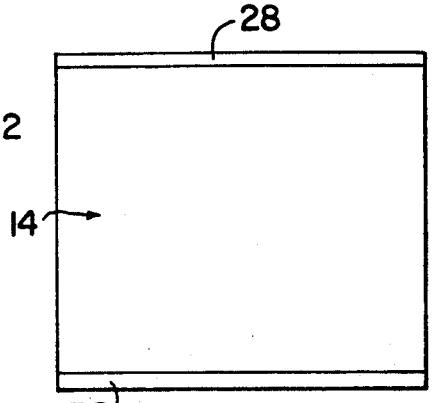

As shown in FIGS. 1A-1C, 2A-2C, and 3A-3C, 2 and 3, prefabricated wall panels 10, 12 and 14 may be formed with varying panel widths as shown, without windows as shown at A, with windows as shown at B and C, and with the windows 16, 18, 20 located at upper and lower locations as shown at C and B respectively in FIGS. 1, 2 and 3.

Figure 4:
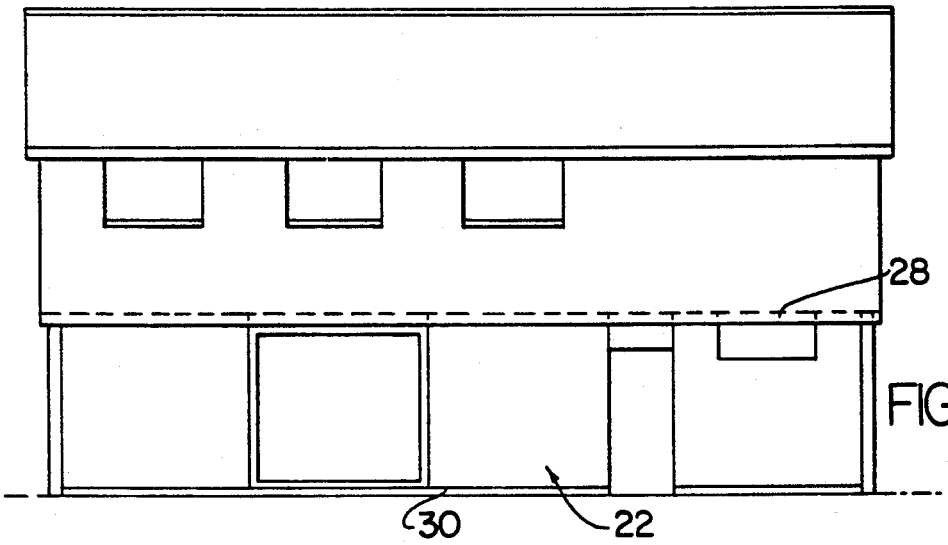
Figure 5:
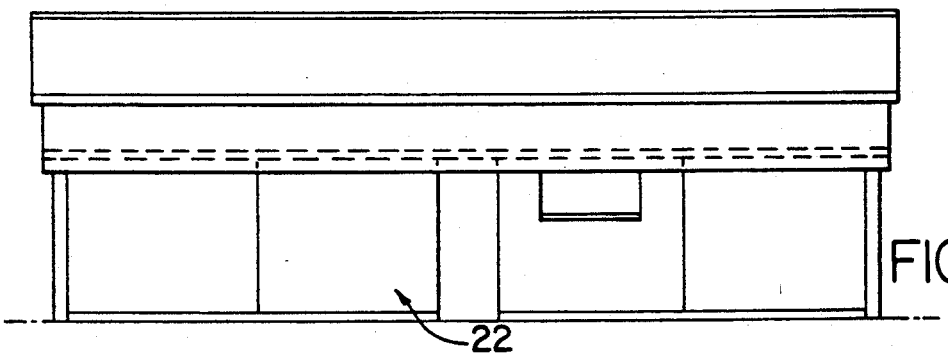
Figure 6:
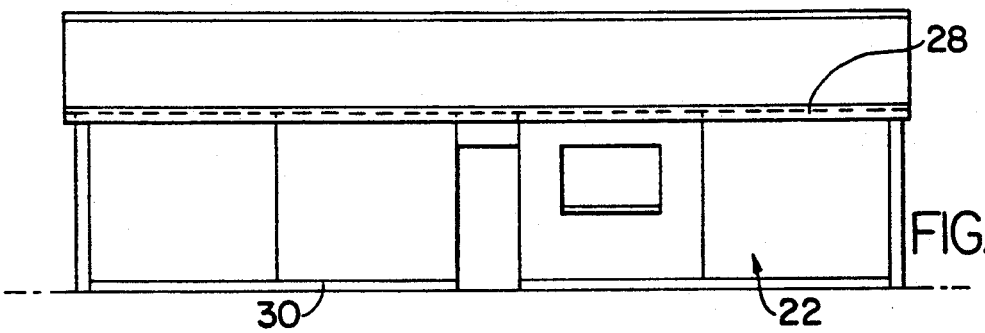

FIGS. 4, 5 and 6 show prefabricated panels, similar to those of the preceding FIGURES, installed in a two storey building (FIG. 4) and in single storey buildings (FIGS. 5 and 6). The building panels of the invention are principally applicable to the construction of the ground floor portion of a building, though other applications are by no means excluded.

Figure 7:
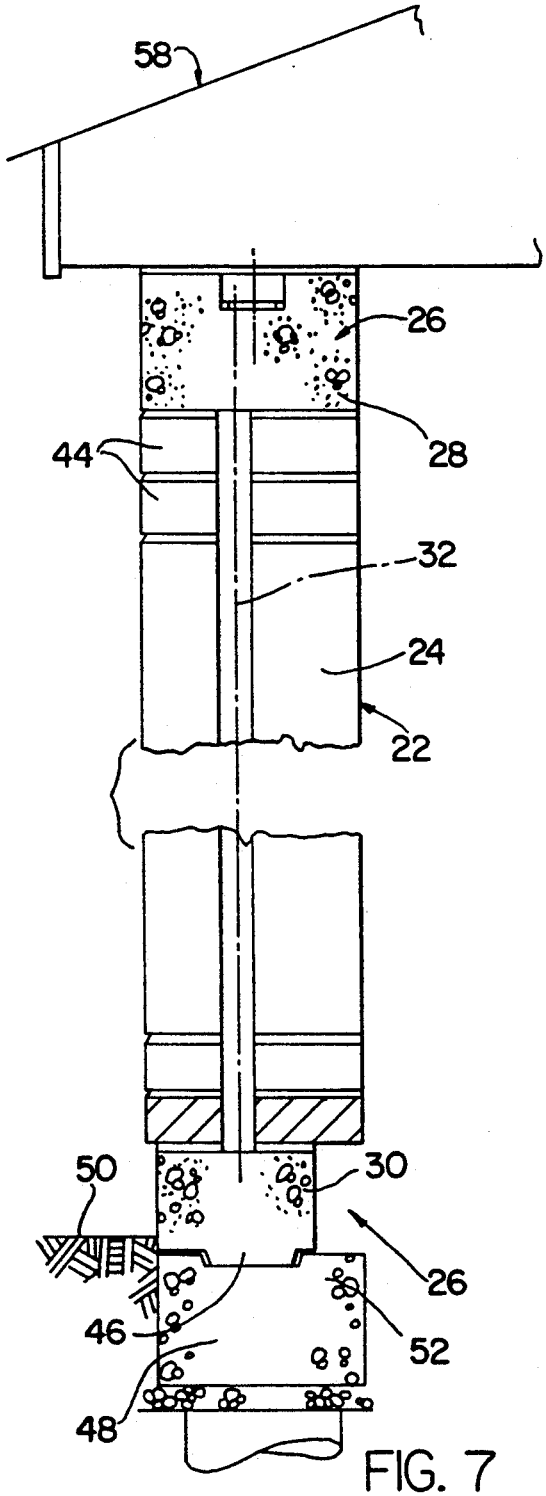
FIG. 7 shows a vertical section through a panel, for example in the building shown in FIGS. 5 and 6, for a single storey situation.
Figure 8:
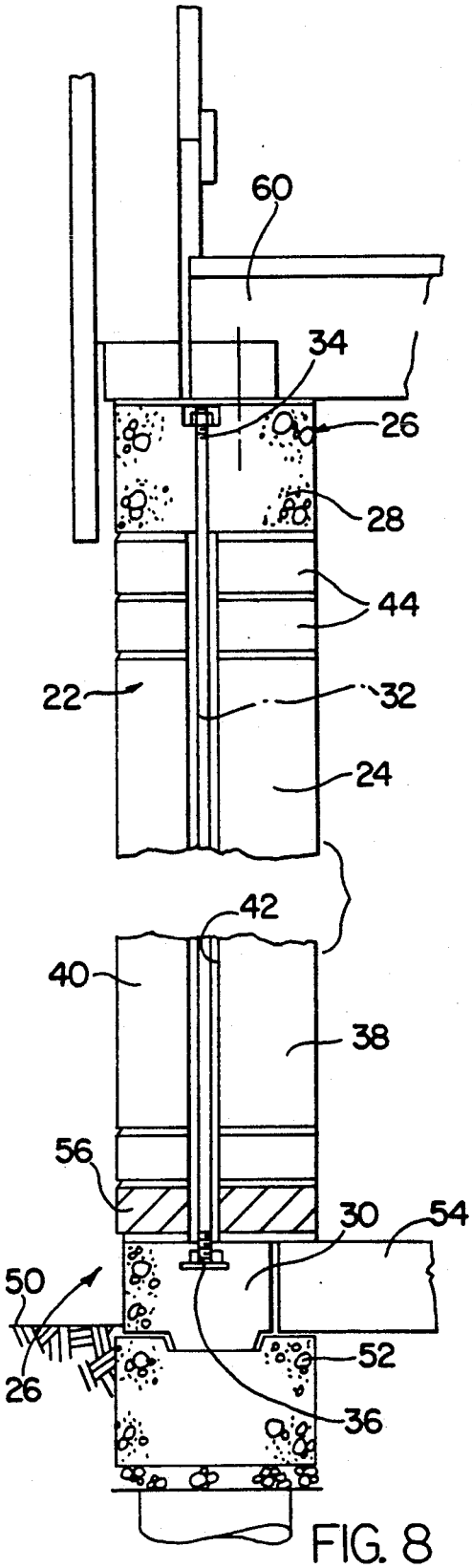
FIG. 8 shows, in a view similar to that of FIG. 7, the arrangement of the wall panel in a two storey building, as indicated in FIG. 4.

Turning now to the construction shown in FIGS. 7 and 8, it will be seen that the panel 22 comprises a main body portion 24 formed of building bricks or blocks together with support means 26 to resist separation of the building bricks or blocks.

The support means 26 comprises upper and lower structural elements 28, 30 in the form of concrete beams linked by tension members 32 in the form of threaded rods of mild steel or other suitable material. The rods are threaded at their ends 34, 36 for co-operative engagement with internally threaded nut or the like members associated with the beams 28 and 30, whereby the beams can be caused to apply compressive loads to the panel assembly, thereby setting up tension in the rods 32.

The upper beam can be in the form of a shaped coping to fit on top of the blocks or bricks directly to act as a means of weather protection when used on free-standing walls.

The method of making panels 22 comprises placement of the lower concrete beam 30 in a jig, building in superimposed vertical relationship successive rows of bricks or blocks with mortar in an otherwise conventional manner, but carried out within the jig and at a factory location. When the panel has been built up to the required height the upper beam 28 is secured in position and the tensioning rods 32 are inserted. Before transportation, the necessary tension is set up in these rods whereby the panel as a whole is provided with a unitary and cohesive structure. The beams remain a structural part of the panel after assembly with other panels into a wall.

It will be noted that the panels 22 have inner and outer layers 38, 40 separated by a cavity 42 through which the rods 32 extend. The building bricks or blocks 44 are shown individually, just at the upper portion of each of FIGS. 7 and 8, by way of example.

The lower beam 30 has a locating ridge 46 Which cooperates with a corresponding channel in a foundation beam 48 suitably set into the ground 50. A shoulder 52 on beam 48 serves to support a floor structure 54. Directly above this, a horizontally extending plate 56, equal in width to the full width of the panel 22 serves to support fully the inner course or layer 38 of the cavity Wall.

FIG. 7 shows panel 22 having a roof structure 58 directly mounted on upper beam 28, whereas FIG. 8 shows a floor structure 60 supported on beam 28.

Figure 11:
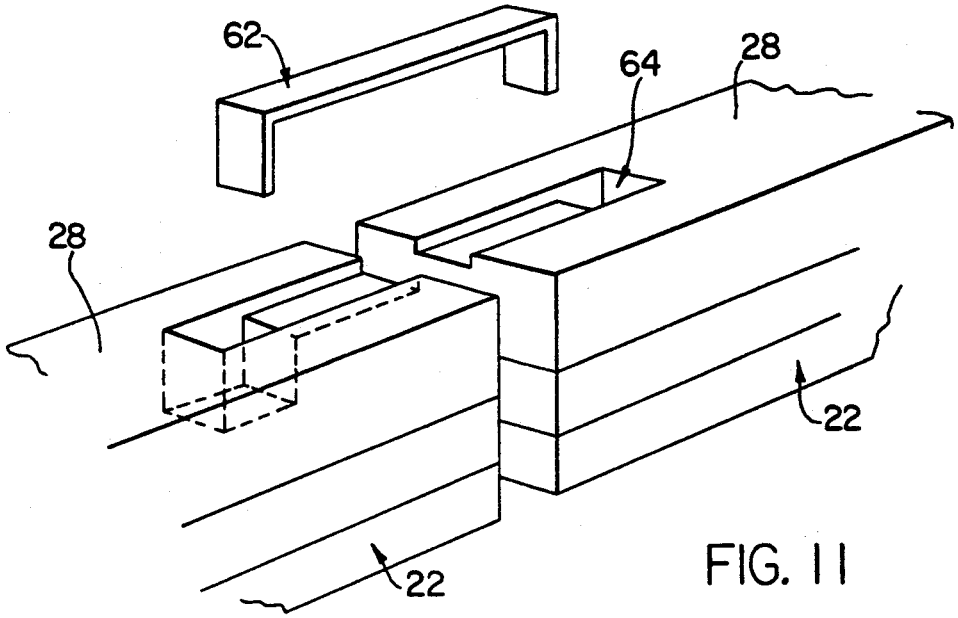
FIG. 11 shows a perspective view of a connector or continuity bar for connecting adjacent panels.

FIG. 11 shows a connector 62 which is of generally channel-shaped section and may be of any similar section and formed of stainless steel which is adapted to cooperate with corresponding recess 64 formed in the upper side of upper beam 28, to link successive panels 22 together. Connector 62 fits into the recess 64 at both sides of the joint, and is then grouted-in.

Figure 9:
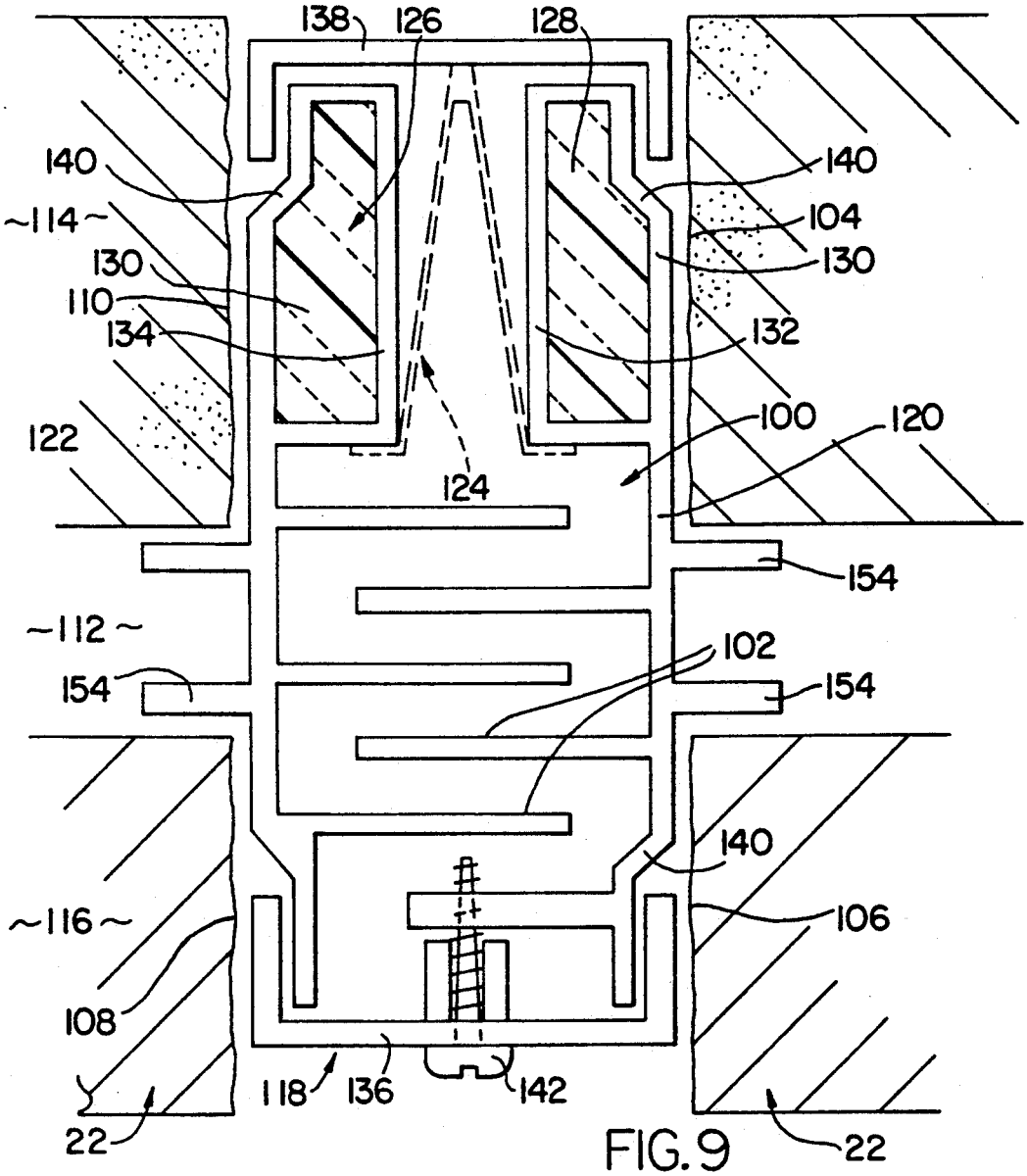
FIG. 9 shows, on a larger scale, a horizontal section through a joint element for sealing between wallpanels in the structures of the preceding FIGURES.

Turning now to the structure of the joint element shown in FIG. 9, it will be seen that this comprises a labyrinth seal 100 having interleaved seal elements 102 extending lengthwise of the joint element to Provide a seal between the adjacent edges 104, 106, 108, 110 of the inner and outer layers of a cavity wall formed by panels 22 and described above. Cavities 112 are provided between the inner blockwork layers 114 and the outer brick layers 116.

Each joint element 118 comprises joint side members 120, 122 having spring means 124 acting between them whereby the joint assembly is resiliently compressible. The spring means 124 is in the form of a generally V-shaped leaf spring located between compartments 126 and 128 containing thermal insulation material 130, which also fills the space between the inner walls of the compartments 126, 128.

It can now be seen that the joint element 118 is in the form of a four piece structure comprising the two side members 120, 122 carrying the labyrinth seal elements 102 and formed with chambers 132, 134 defining the cavities 128, 126 respectively. The other two pieces are outer and inner cap members 136, 138 respectively. These are of channel-shaped cross-section, extend Vertically between the confronting edges 106, 108 and 104, 110 of the outer and inner leaves of the cavity wall constructions. Joggles 140 formed in the side members 120, 122 provide space for the caps 136, 138. Leaf spring 124 is secured to cap 138, and thus serves to hold same in position by engagement with chambers 132, 134. Likewise, outer cap 136 is secured by self tapping screws 142 to the outer most seal member 102 of the labyrinth seal 100. Cap 136 constitutes decorative panel means to provide a visually pleasing cover over the joint element 118. It can be provided with any desired surface finish or may otherwise be adapted to enhance its appearance.

Figure 10:
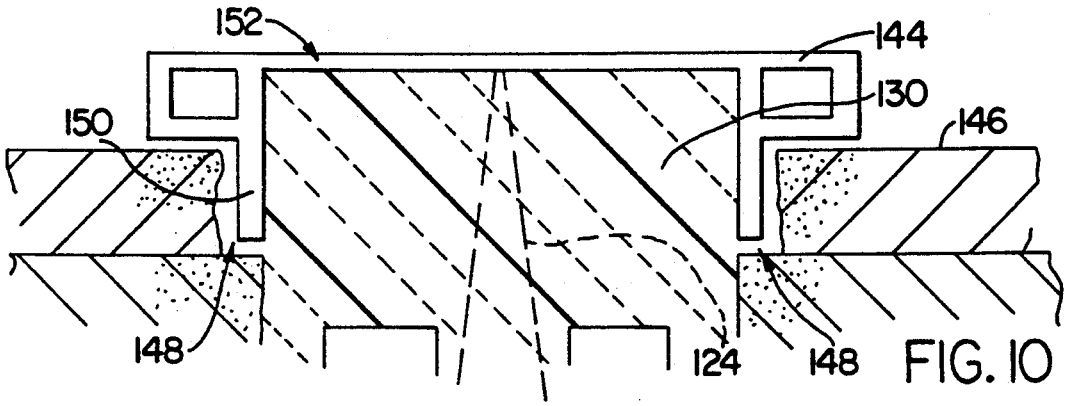
FIG. 10 shows a modification of the joint element of FIG. 9.

FIG. 10 shows a modification of cap 138 Whereby it is provided with a portion 144 standing proud of the inner surface 146 of the wall. A suitable rebate 148 is formed in the wall to receive the side limbs 150 of the cap 152.

The location of the joint element with respect to the cavity wall itself is provided by means of lugs 154 extending into the cavity 112.

Figure 12:
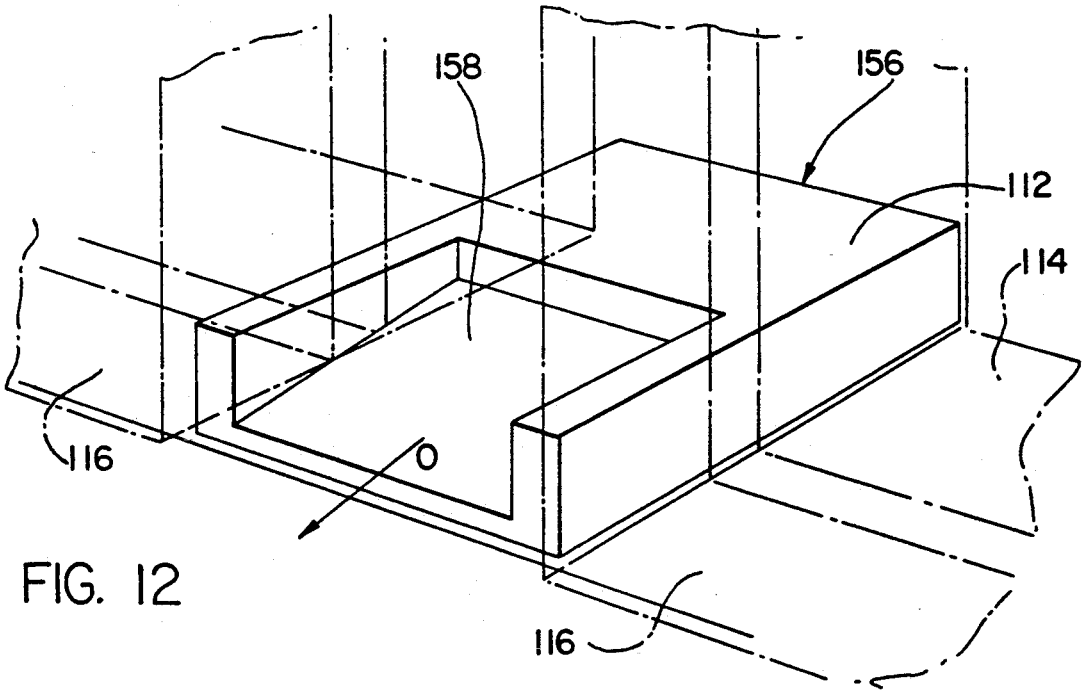
FIG. 12 shows a perspective view of a water tray provided at the base of ajoint between successive panels in a wall constructed according to the invention.

FIG. 12 shows the construction of a water tray provided at the base of the joint element 118 to receive any water entering the joint, and to deflect the water outwards. For this purpose, the water tray 156 is of generally rectangular shape construction. The joint element rests with its lower end on the water tray and with the labyrinth seal 100 located over an outwardly sloping surface 158, whereby water separated by the seal is deflected outwardly of the wall structure in the direction indicated by arrow 0. In FIG. 12 the location of cavity 112, and of the inner and outer cavity wall layers 114 and 116 respectively are indicated by dotted lines.

In use, joint element 118 is readily inserted into the space between the adjacent edges of the assembled panels 22. Its resilient construction enables it to be inwardly compressed. Lugs 154 are located within cavity 112. Then, the inner and outer caps 138 and 136 are attached and assembly is complete.

Inward movement of water from brick panel 116 across cavity 112 is inhibited by the labyrinth seal 100. Liquid entering the joint element tends to pass downwards and onto water tray 156 and thus to be ejected outwards.

The insulating material 130 provides a thermal barrier between the panel elements, with a thermal insulation coefficient comparable to that of the wall itself.

In a further embodiment (not illustrated), the joint element is modified to form a structural member of the assembled wall and can be fixed to the perimeter foundation beams of the panels to give support to the wall panels for use on free-standing walls.

Interestingly, in the above embodiments, the provision of prefabricated wall panels with tension type supporting structure enables the panels to be assembled in a factory environment in an efficient and controlled manner, using basically conventional vertical stacking type assembly techniques. The assembled Panels can then be transported without danger of disintegration, by virtue of the supporting structure, and assembled with an absolute minimum of modification. In principle none of the panel structure has to be removed for assembly of a wall. After assembly, the hitherto intractable problems of heat loss and entry of moisture together with loss of heat are solved by means of the joint element. This Provides an easily mounted structure which resiliently accommodates varying gap sizes between the panels and offers a thermal insulation co-efficient comparable to a brick wall itself. Its labyrinth seal substantially prevents ingress of moisture and it has a decorative finish which serves to enhance rather than, as is usually the case, allowing the joint area to detract from the appearance of the assembly.

The wall panels and the joint elements are suitable to be made either in whole or in part using robotic technology.

Amongst other modifications which could be made in the above embodiments while remaining within the scope of the claims are the following. Firstly, the wall panels or elements can be readily constructed to any suitable shape or size by suitably adapting the jig used for construction purposes. Likewise, instead of conventional bricks or other building blocks, any suitable building material may be employed to provide an assembly of building elements from which the panel is constructed. A further modification comprises forming the Panel with a single leaf construction and no internal cavity. Also, various modifications to the support structure can be envisaged whereby the latter might comprise a removeable structure rather than an integral part of the Panel itself. In the above embodiment, after assembly, the tension rods can be removed or retained as desired.

We claim:

1. A transportable wall panel comprising horizontally extending top and bottom support beams, front and rear wall portions including masonry blocks provided between said beams, motor provided between said blocks, said front and rear wall portions defining a cavity therebetween, tensioning means provided between said top and bottom beams in the cavity defined between said front end wall portions, and a joint assembly for placement between adjacent wall panels at a building site, said joint assembly including joint elements associated with the marginal edges of the adjacent wall panels, each joint element defining a portion projecting into a space defined by a portion of an adjacent joint element to form a labyrinth therebetween, said joint elements extending generally parallel the marginal edges of the wall portions adjacent said joint elements.

2. The combination according to claim 1 further including thermal insulation compartments defined by said joint elements attached to said adjacent marginal edges of said wall portions and a thermal insulation material provided in said compartments.

3. The combination according to claim 2 wherein said joint elements include portions extending laterally of the longitudinal direction of said labyrinth defining elements so as to occupy at least a portion of the cavity between said front and rear wall portions of said adjacent panels.

4. The combination according to claim 3 wherein said thermal compartments are provided adjacent rear sides of the rear wall portions of said labyrinth defining joint elements.

5. The combination according to claim 4 wherein a detachable decorative panel is secured to said joint elements between adjacent wall portions at the rear side of said rear wall portions.

6. The combination according to claim 5 wherein each of said joint elements has a width in the range between 25–100 millimeters.

7. The combination according to claim 5 wherein each of said joint elements has a width in the range between 40–80 millimeters.

* * * * *

UNITED STATES PATENT AND TRADEMARK OFFICE

CERTIFICATE OF CORRECTION

PATENT NO. : 5,182,886

DATED : February 2, 1993

INVENTOR(S) : Colin N. Bateman, Peter L. Clark, William G. Carter

It is certified that error appears in the above-identified patent and that said Letters Patent is hereby corrected as shown below:

Col. 6, line 51, "motor" should be --mortar--.

Col. 6, line 55, "end" should be --and rear--.

Signed and Sealed this

Seventh Day of December, 1993

*Attest:*

*Attesting Officer*

Bruce Lehman

BRUCE LEHMAN

*Commissioner of Patents and Trademarks*